United States Patent [19]

Voegel et al.

[11] Patent Number: 4,552,638

[45] Date of Patent: Nov. 12, 1985

[54] ELECTRODE ASSEMBLY HAVING IMPROVED CURRENT DISTRIBUTION FOR USE IN AN ELECTROLYTIC REDUCTION CELL

[75] Inventors: Robert L. Voegel; Kenton B. Wright, both of Newburgh, Ind.

[73] Assignee: Aluminum Company of America, Pittsburgh, Pa.

[21] Appl. No.: 670,077

[22] Filed: Nov. 13, 1984

[51] Int. Cl.[4] ..... C25D 17/12

[52] U.S. Cl. ..... 204/286; 204/243 R; 204/294; 204/67

[58] Field of Search ..... 204/67, 243 R, 243 M, 204/244, 245, 246, 247, 280, 286, 294, 297 R

[56] References Cited

U.S. PATENT DOCUMENTS

| | | | |
|---|---|---|---|
| 1,036,654 | 8/1912 | Leffel | 204/286 |
| 1,679,284 | 7/1928 | Westly | 204/280 X |
| 2,528,905 | 11/1950 | Ollivier et al. | 204/243 |
| 2,594,881 | 4/1952 | De Quasie et al. | 204/286 |
| 2,624,703 | 1/1953 | Park | 204/247 |
| 2,980,596 | 4/1961 | Conway | 204/243 R X |
| 3,280,231 | 10/1966 | Bentolila et al. | 264/29 |
| 3,707,764 | 1/1973 | Frankovich | 29/527.6 |
| 4,395,613 | 7/1983 | Barr et al. | 219/69 E |
| 4,425,200 | 1/1984 | Arita | 204/67 |
| 4,448,661 | 5/1984 | Roggen | 204/243 R |

FOREIGN PATENT DOCUMENTS

| | | | |
|---|---|---|---|
| 1187807 | 2/1965 | Fed. Rep. of Germany | 204/286 |
| 1937411 | 9/1971 | Fed. Rep. of Germany | 204/286 |
| 3100921 | 8/1982 | Fed. Rep. of Germany | 204/286 |
| 2051864 | 1/1981 | United Kingdom | 204/67 |
| 378524 | 6/1973 | U.S.S.R. | 204/286 |
| 537130 | 12/1976 | U.S.S.R. | 204/286 |
| 954522 | 8/1982 | U.S.S.R. | 204/286 |

*Primary Examiner*—G. L. Kaplan

*Attorney, Agent, or Firm*—Andrew Alexander; John P. Taylor

[57] ABSTRACT

An improved electrode assembly is disclosed for use in a cell for the production of metal by electrolytic reduction comprising a nonmetallic conductive electrode having a top surface and a central current carrying support shaft received in a central bore extending axially downward from the top surface. Conductive fin members extend radially from the central support shaft in the electrode, the fin members comprising a plurality of gate members extending radially from the central shaft adjacent a top surface of the electrode and wing members extending from the gate members downwardly into the electrode from the top surface. The gate members are provided with a width exceeding the depth at least adjacent the top surface of the electrode to provide better heat dissipation adjacent the top face of the electrode. Current passing to the nonmetallic conductive electrode from the central shaft may thus be distributed evenly in the electrode to minimize the voltage drop in the electrode, permit the electrode to run cooler, and reduce the probability of burnoffs.

16 Claims, 6 Drawing Figures

HEAT GENERATED NEAR STUB
(6 INCH REGULAR AND WINGED)

ELECTRODE ASSEMBLY HAVING IMPROVED CURRENT DISTRIBUTION FOR USE IN AN ELECTROLYTIC REDUCTION CELL

BACKGROUND OF THE INVENTION

1. Field of the Invention

This invention relates to an electrode assembly used in the production of metal in electrolytic reduction cells. More particularly, this invention relates to improvements in current distribution through the electrode assembly to reduce the voltage drop therein and improve the heat dissipation.

2. Description of the Prior Art

In the production of metal, such as aluminum, in an electrolytic reduction cell, anodes and cathodes are used which are constructed, principally, of conductive material, such as carbon, which will conduct the high currents used for the electrolytic reduction to the molten salt bath in the cell. Carbon electrodes are normally used to avoid contamination of the bath with foreign metals and to lower necessary reduction voltage.

The current is normally carried to the electrode by large conductor busses which, in the case of the anode is, in turn, directly connected to the anode via a metal rod which also functions as a mechanical support for the anode and is lowered or raised in the cell and incidentally as a cooling heat sink. The need for the anode to function as a heat sink varies as cell current density changes.

Conventionally, the anode is attached to the metallic rod by inserting the rod into a central bore formed in the top of the anode. An electrically conducting ram mix may then be placed into the space between the rod and the bore in the anode. This connection, however, can be less than satisfactory from a mechanical standpoint, speed of assembly and electrically as well as by providing a higher resistance at the interface. This problem has been partially addressed in the prior art. For example, German Pat. No. 1,187,807 discloses a carbon anode having one or more cavities to receive a metal stub or rod. The surfaces of the cavities have grooves or teeth to increase the surface area which is said to provide better conductivity of the current from the rod into the anode.

German Pat. No. 1,937,411 provides for a cast iron structure to be poured around a steel stub placed in the end of a carbon anode. The purpose of the cast iron structure apparently, is to spread the current distribution across the top surface of the anode, as well as to lock the metal rod or stub to the anode by providing an undercutting in the sidewall of the recess cut into the top surface of the anode to receive the molten cast iron. The cast iron, as it solidifies, then provides a dovetail-like fit in the anode to prevent or inhibit the stub from separating from the anode.

While such arrangements do provide better mechanical bonding between the steel support rod and the anode and do provide some current distribution improvements, the current distribution is still limited to an area or volume immediately surrounding the metal rod or, at best, only across the upper surface of the anode.

Russian Pat. No. 378,524 illustrates a carbon electrode structure having the usual central bore to receive a metal stub and also having a series of holes drilled into the carbon block parallel to the central bore to receive cast iron rods. Openings are then cut into the carbon between the central bore and the cast iron rods to permit cast iron bridge pieces to be poured to connect the cast iron rods to the metal stub. The purpose of the rods is to reduce power losses.

Despite these attempts to distribute the current more evenly in the anode, there remains a need to optimize the distribution of current from the central stub to the anode as well as from the rod within the cathode to reduce voltage drops therebetween as well as to dissipate heat generated by such voltage drops which can otherwise result in burnoffs of the anodes.

SUMMARY OF THE INVENTION

It has been found that the foregoing problems may be overcome, at least in part, by providing current carrying metallic members in the electrode which are symmetrically spaced around the central support rod including gate members having a width exceeding the depth to increase the heat dissipation and wing members which extend downwardly into the electrode toward the bottom of the electrode at least the distance of the central support rod.

It is, therefore, an object of the invention to provide an electrode assembly for an electrolytic reduction cell having improved current distribution characteristics.

It is another object of the invention to provide an electrode assembly for an electrolytic reduction cell having improved current distribution characteristics wherein conductive means are symmetrically spaced around the electrode support rod and have wing members thereon which extend downwardly into the anode.

It is yet another object of the invention to provide an electrode assembly having improved current carrying capabilities wherein the conductive means comprise current carrying means which have gate members symmetrically spaced around the central support shaft and wing members thereon which extend downwardly into the electrode, each of the gate members having a width, at least adjacent the upper surface of the electrode, greater than its depth to increase the heat dissipation capacity of the electrode assembly and to lower the temperature of the wing members to thereby provide higher electrical conductivity.

These and other objects of the invention will be apparent from a reading of the description and accompanying drawings.

In accordance with the invention, an improved electrode assembly is provided for use in a cell for the production of metal by electrolytic reduction comprising a nonmetallic conductive electrode having a top surface and a central current carrying support shaft received in a central bore extending axially downward from the top surface. Conductive fin members extend radially from the central support shaft in the electrode, the fin members comprising a plurality of gate members extending radially from the central shaft adjacent a top surface of the electrode and wing members extending from the gate members downwardly into the electrode from the top surface. The gate members are provided with a width exceeding the depth at least adjacent the top surface of the electrode to provide better heat dissipation adjacent the top face of the electrode. Current passing to the nonmetallic conductive electrode from the central shaft may thus be distributed evenly in the electrode to minimize the voltage drop in the electrode, permit the electrode to run cooler, and reduce the number of burnoffs.

DESCRIPTION OF THE PREFERRED EMBODIMENTS

Figure 1:
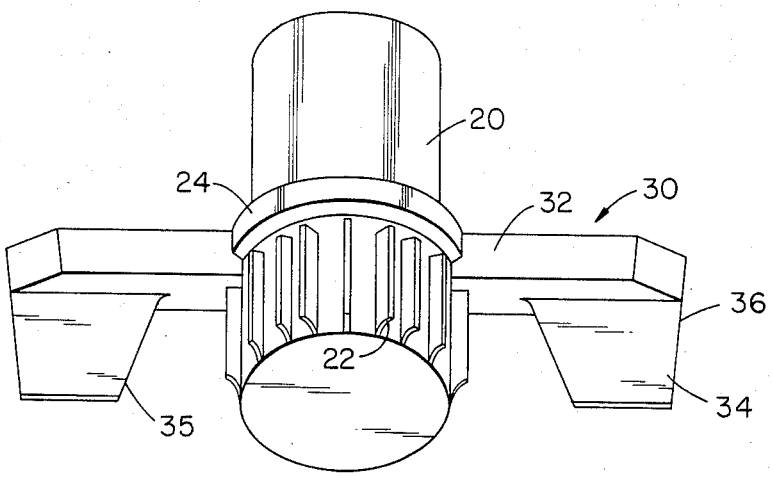
FIG. 1 is an oblique view of one embodiment of the current distributing fin assembly portion of the invention.
Figure 2:
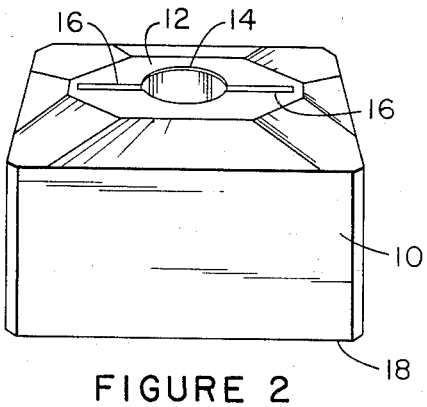
FIG. 2 is an oblique view of the nonmetallic conductive electrode which receives the fin assembly of FIG. 1 to comprise the electrode assembly of the invention.

Referring now to FIGS. 1 and 2, the electrode assembly of the invention is shown comprising a nonmetallic electrode block 10 having a central bore 14 formed in the top portion thereof to receive a central support shaft 20. In accordance with the invention, nonmetallic electrode 10 is formed with portions 16 which radially extend from bore 14 to permit the fin assembly 30 shown in FIG. 1 to be cast in situ therein around central support shaft 20 thereby avoiding the need for secondary machining of the nonmetallic electrode body.

It will be noted herein that electrode 10 is illustrated in the form of an anode. However, the current distribution and heat dissipation characteristics of the invention described herein can be used in cathode construction as well. The current carrying assembly of the invention will, therefore, be referred to as an electrode assembly although illustrated in the form of an anode.

In the preferred embodiment, nonmetallic electrode 10 comprises a carbon block although the use of other types of conductive electrode material, such as combinations of metals and metal oxides, which have been formed into materials relatively inert to the molten metal, and salt normally found in an electrolytic reduction cell, may be used. Design configurations may vary slightly depending upon the electrode material used.

Central support shaft 20 comprises a steel shaft which provides both mechanical support and electrical connection from an external power supply to electrode 10. Central support shaft 20 is secured in bore 14 of electrode 10 by pouring molten metal, such as cast iron, around the shaft 20 which is formed slightly smaller than bore 14. Bore 14 is preferably formed with ribbed portions which result in the formation of fluted portions 22 on shaft 20 by the cast iron metal poured into bore 14 around shaft 20. Shrinkage, during cooling of the cast iron after pouring, tightens the joint and provides good electrical contact during the critical heatup portion of operation following installation of the electrode in the cell. A dust lip 24 may also be formed by the provision of a larger cutaway portion adjacent the end of bore 14.

Conventionally then, the current in shaft 20 is distributed to electrode 10 via the contact between the cast iron metal in bore 14 and the adjoining area of nonmetallic electrode, e.g., carbon or the like. This type of construction can, however, result in considerable generation of heat at the metal-nonmetallic electrode interface which, in turn, can result in premature burnoff.

Thus, in accordance with the invention, fin assemblies 30 are provided comprising metal members which are contiguous with shaft 20. In a preferred embodiment, electrode 10 is formed with cutaway portions to permit the formation of fin assemblies 30 in situ therein by the pouring of molten metal, such as cast iron, into the openings formed in the top surface of electrode 10. This serves to provide the necessary mechanical locking of shaft 20 into electrode 10 as well as providing good electrical contact between shaft 20 and fin assembly 30.

Fin assembly 30 comprises gate members 32, which extend from shaft 20 radially adjacent top surface 12 of electrode 10, and wing members 34 which extend downwardly from gate members 32 into electrode 10 and toward the bottom edge 18 thereon. This permits the current in shaft 20 to flow through the gate members 32 into the wing members 34, from which the current flows into nonmetallic electrode 10 in contact therewith, thereby providing a distributed current flow.

Figure 3:
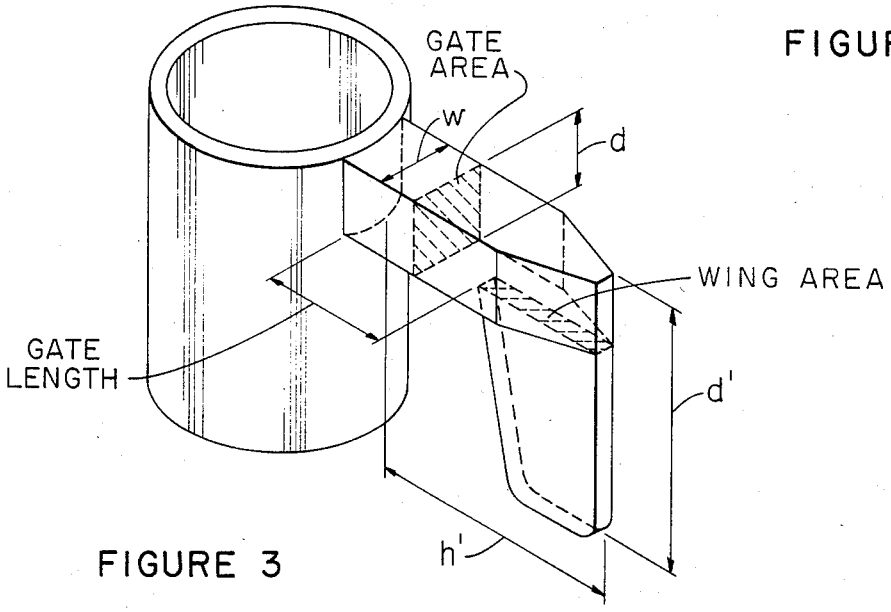
FIG. 3 is a perspective view of the fin assembly portion of the invention with dotted lines indicating certain structural dimensions.

Since the resistivity of cast iron is increased with increase in temperature, it is important that the heat generated in the contact between the metallic shaft 20 and fin assembly 30 with the nonmetallic electrode 10 be dissipated to permit the electrode to function as cool as possible to increase the conduction. Therefore, in accordance with a preferred embodiment of the invention, the width "w" of gate 32 should exceed the depth "d" of gate 32, as shown in FIG. 3. This, in turn, will increase the surface area per unit length of the gate area thus permitting more heat to be dissipated from the top surface of gate 32.

The length of gate 32 may vary with various cross sections of electrodes. However, to prevent shrinkage cracking of fin assembly 30, the cross-sectional area of the gate 32 should equal k times the length of the gate where:

$$k=0.85\times[mean\ C.T.E.\times(T_{solidus}-T_{room})+1]$$

and C.T.E. equals the coefficient of temperature expansion of the metal used. The sloped portion 35 of fin assembly 30 further helps tighten the joint in a cooled state and reduces strain on the wing and gate.

Conventionally, the current distribution from shaft 20 to electrode 10 was across the area of contact between the two members. Therefore, all of the heat generated across this contact was in the area immediately surrounding shaft 20. However, in accordance with the invention, a portion of the current is distributed to electrode 10 via the fin assembly 30. In accordance with the invention, the sum of all of the gate areas, i.e., the sum of the products of the width "w" times the depth "d" of each gate area should be greater than 6% of the central shaft cylinder area in contact with electrode 10 to provide sufficient current distribution as well as heat dissipation spaced from the interface between shaft 20 and electrode 10. Further, the sum of the resistances of all of the gates should be equal to or less than 1.2 times the resistance of the carbon element.

Preferably, the depth "d'" of wing 34 should equal the depth of shaft 20 in bore 14 whereby the current distributed into the electrode will be maximized by the increased area of contact between the wings and the nonmetallic electrode. It is also preferable that the wing thickness "t" be at least equal to one half of the wing width "w" to provide sufficient contact area between the nonmetallic electrode and the outer edge 36 of wing member 34. Further, the length L' of wing member 32 should be at least equal to the diameter of the central shaft.

In a preferred embodiment, the fin assembly 30 comprises cast iron which is poured into the openings formed in electrode 10. This material is preferred due to its mechanical and electrical properties and ease of handling. Other metals possessing superior electrical conductivity, mechanical strength, and handling characteristics may be substituted therefor. In a preferred embodiment, the cast iron should contain at least 2.5% carbon to permit volume growth of the cast iron during operation at elevated temperatures as the carbon diffusion therein results in temper carbon precipitation. This growth helps to tighten the joints between the nonmetallic electrodes, such as a carbon anode, and the cast iron joints, thus providing enhanced electrical conductivity.

Figure 4:
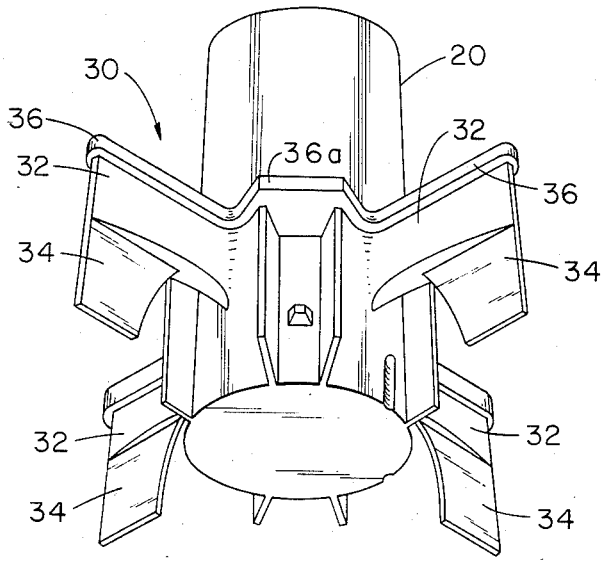
FIG. 4 is an oblique view of another embodiment of the current distributing fin assembly portion of the invention.
Figure 5:
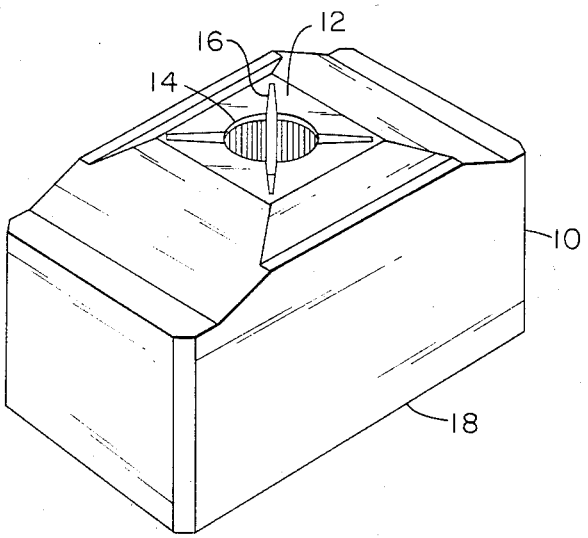
FIG. 5 is a perspective view of the nonmetallic electrode which receives the fin assembly of FIG. 4.

Turning now to FIGS. 4 and 5, yet another embodiment of the electrode assembly of the invention is illustrated wherein fin assembly 30 comprises four gates 32 with wing members 34 depending thereon which are symmetrically spaced radially around shaft 20. In this embodiment, the heat dissipating characteristics of gate 32 are enhanced by providing a wide lip member 36 which extends around the top portion of gate 32 to provide an enlarged surface contiguous with top surface 12 of electrode 10 to maximize the heat dissipation from gate assembly 32. As shown in FIG. 4, this heat dissipating surface 36 may be extended by providing portions **36*a* in between the spaced apart fin assemblies 30. This is made possible by initially forming electrode 10 with cutaway portions in the top surface 12 thereof which permit the formation of the heat dissipating member 36*a* when the molten metal, such as cast iron, is poured into the formed openings in electrode 10**. This ring also expedites accurate pouring of molten cast iron and, in trade-offs between casting weight and efficiency, may be placed in only one quadrant.

Figure 6:
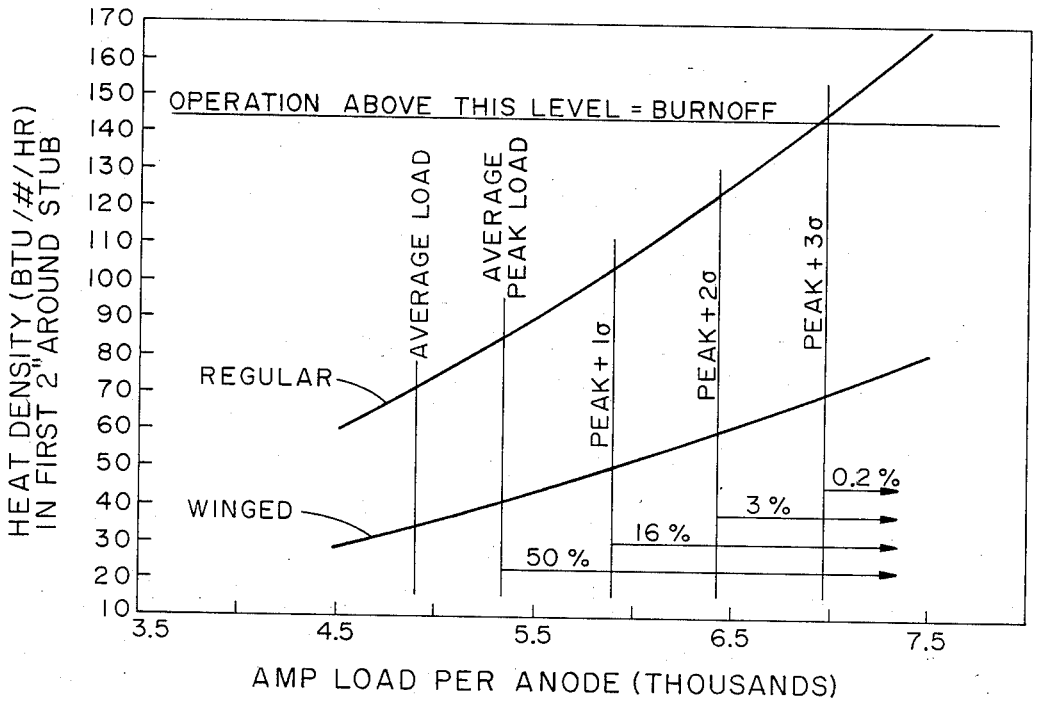
FIG. 6 is a graph showing heat generated using the electrode assembly of the invention versus the prior art.

In FIG. 6, a graph is shown which illustrates the amount of heat which is generated, respectively, by an electrode assembly formed in accordance with the invention and a conventional electrode assembly formed using only the central support shaft received in a corresponding bore formed in the top of the electrode. In both instances, the metallic portions extend six inches downwardly into the nonmetallic electrode from the top surface. It will be readily apparent that, for any particular ampere load on the graph, the electrode assembly of the invention results in considerably less heat generated near the shaft or stub. This is important both from the standpoint of electrical conductivity (due to the increase in resistivity of cast iron as the temperature increases) as well as mechanical strength due to the possible softening or slush forming of the molten metal as the heat increases in a localized area surrounding the support shaft. As noted in FIG. 6, the tolerated overload is substantially increased with dramatic impact on burnoff probability.

Thus, the invention provides an improved electrode assembly for use in an electrolytic reduction cell for the production of metal wherein the current is more uniformly distributed through the electrode, thus reducing the amount of voltage drop in the metal-nonmetallic interface and cooler performance of the electrode.

Having thus described the invention, what is claimed is:

1. An improved electrode assembly for use in a cell for the production of metal by electrolytic reduction in a molten salt bath comprising:

(a) a nonmetallic conductive electrode having a top surface;

(b) a central current carrying metallic support shaft received in a central bore in said electrode extending axially downward from said top surface; and (c) metallic fin members extending radially from said central support shaft in said electrode, said metallic fin members comprising a plurality of gate members extending radially from said central shaft adjacent said top surface of said electrode and wing members extending from said gate members downwardly into said electrode from said top surface, said gate members each having a width exceeding the depth of said gate member at least adjacent the top surface of said electrode to increase the surface area of said gate member whereby heat generated adjacent the interface between said nonmetallic conductive electrode and said metallic fin members may be dissipated.

2. The electrode assembly of claim 1 wherein the cross-sectional area of said gate is equal to k times the length of the gate to prevent shrinkage cracking of portions of said metallic fin members wherein:

$$k=0.85\times[mean\ C.T.E.\times(T_{solidus}-T_{room})+1]$$

where C.T.E. equals the coefficient of temperature expansion of the metal used in forming said electrode assembly.

3. The electrode assembly of claim 1 wherein said metallic fin assembly comprises cast iron.

4. The electrode assembly of claim 3 wherein said cast iron fin assembly is formed by pouring molten metal into openings formed in said nonmetallic electrode.

5. The electrode assembly of claim 4 wherein said central metallic support shaft is placed in said central bore before said molten metal is poured into said openings whereby said cast iron fin assembly is contiguous with cast iron portions surrounding said central support shaft to provide enhanced mechanical strength and current distribution to said assembly.

6. The electrode assembly of claim 3 wherein said nonmetallic conductive electrode comprises carbon.

7. The electrode assembly of claim 6 wherein said cast iron contains greater than 2.5 wt. % carbon to promote volume growth of said cast iron fin assembly as carbon diffusion results in graphite precipitation whereby said growth will tighten carbon-cast iron joints in said electrode assembly.

8. The electrode assembly of claim 6 wherein the resistance of the sum of said gate areas is less than 1.2 times the resistance of the carbon around the cylindrical portion of said central support shaft within said central bore to provide greater than 30% of the current distribution to said nonmetallic electrode through said gate members to said fin members.

9. The electrode assembly of claim 6 wherein each of the gate areas in said fin assembly is at least equal to the wing area of said wing member depending from said gate member to provide sufficient current to said wing members.

10. The electrode assembly of claim 6 wherein the depth of said wing members is approximately equal to the depth of said central support shaft in said central bore in said electrode whereby the current distributed into said electrode will be maximized by the increased area of contact between said wings and said carbon electrode.

11. The electrode assembly of claim 6 wherein the thickness of said wing member adjacent the outer edge thereof is at least one-half the width of said wing member to provide sufficient contact area between said nonmetallic electrode and the outer edge of said wing member.

12. The electrode assembly of claim 6 wherein the length of said wing member is at least equal the diameter of the central shaft.

13. The electrode assembly of claim 6 wherein flutes are spaced around said central bore each having a length at least two times the flute width to provide effective heat transfer from near the bore into the central shaft.

14. An improved electrode assembly for use in a cell for the production of metal by electrolytic reduction in a molten salt bath comprising:

(a) a carbon electrode having a top surface;

(b) a central current carrying metallic support shaft received in a central bore in said electrode extending axially downward from said top surface; and (c) metallic fin members extending radially from said central support shaft in said carbon electrode, said metallic fin members comprising a plurality of gate members extending radially from said central shaft adjacent said top surface of said carbon electrode and wing members extending from said gate members downwardly into said carbon electrode from said top surface, said gate members each having a width exceeding the depth of said gate member at least adjacent the top surface of said electrode to increase the surface area of said gate member whereby heat generated adjacent the interface between said nonmetallic conductive electrode and said metallic fin members may be dissipated, the sum of the areas of said gates being at least equal to the sum of the areas of said wings to provide sufficient current to said wing members, said wing members being further provided with a sloped portion commencing at a lower portion of said gate member and terminating at the extremity of said wing member.

15. An improved anode assembly for use in a cell for the production of metal by electrolytic reduction in a molten salt bath comprising:

(a) a carbon cathode having a central current carrying metallic support shaft received in a central bore in said cathode extending at least partially through said cathode; and (b) metallic fin members extending radially from said central support shaft in said carbon cathode, said metallic fin members comprising a plurality of gate members extending radially from said central shaft and wing members extending from said gate members into said carbon cathode, said gate members each having a width exceeding the depth of said gate member at least adjacent one surface of said cathode to increase the surface area of said gate member whereby heat generated adjacent the interface between said nonmetallic conductive cathode and said metallic fin members may be dissipated.

16. An improved cathode assembly for use in a cell for the production of metal by electrolytic reduction in a molten salt bath comprising:

(a) a carbon cathode having a central current carrying metallic support shaft received in a central bore in said cathode extending at least partially through said cathode; and (b) metallic fin members extending radially from said central support shaft in said carbon cathode, said metallic fin members comprising a plurality of gate members extending radially from said central shaft and wing members extending from said gate members into said carbon cathode, said gate members each having a width exceeding the depth of said gate member at least adjacent one surface of said cathode to increase the surface area of said gate member whereby heat, generated adjacent the interface between said nonmetallic conductive cathode and said metallic fin members, may be dissipated.

* * * * *

UNITED STATES PATENT AND TRADEMARK OFFICE

CERTIFICATE OF CORRECTION

PATENT NO. : 4,552,638

DATED : November 12, 1985

INVENTOR(S) : R. L. Voegel and K. B. Wright

It is certified that error appears in the above-identified patent and that said Letters Patent is hereby corrected as shown below:

| | |
|---|---|
| Col. 8, line 6<br>Claim 15 | Change "cathode" to --anode--. |
| Same col., line 8<br>Same claim | Same as above. |
| Same col., line 9<br>Same claim | Same as above. |
| Same col., line 11<br>Same claim | Same as above. |
| Same col., line 15<br>Same claim | Same as above. |
| Same col., line 18<br>Same claim | Same as above. |
| Same col., lines 20-21<br>Same claim | Same as above. |

Signed and Sealed this

*Twenty-fifth* Day of *February 1986*

[SEAL]

*Attest:*

DONALD J. QUIGG

*Attesting Officer* *Commissioner of Patents and Trademarks*